United States Patent [19]

Strahm

[11] 4,337,630

[45] Jul. 6, 1982

[54] EXTERNALLY HELD CYLINDRICAL EXPANDER FOR TUBULAR WARES

[75] Inventor: Christian Strahm, Küsnacht, Switzerland

[73] Assignee: Lindauer Dornier Gesellschaft mbH., Fed. Rep. of Germany

[21] Appl. No.: 183,368

[22] Filed: Sep. 2, 1980

[30] Foreign Application Priority Data

Sep. 1, 1979 [DE] Fed. Rep. of Germany ..... 2935374

[51] Int. Cl.[3] ..... D06B 23/04

[52] U.S. Cl. ..... 68/13 R; 26/85; 68/175

[58] Field of Search ..... 68/13 R, 175, 184; 26/80, 83, 85; 425/393; 264/563, 565, 566, 569, 290.2

[56] References Cited

U.S. PATENT DOCUMENTS 3,950,466 4/1976 Hasler ..... 264/565

3,976,733 8/1976 Havens ..... 264/565

4,269,046 5/1981 Strahm et al. ..... 68/13 R

*Primary Examiner*—Philip R. Coe

*Attorney, Agent, or Firm*—James E. Bryan

[57] ABSTRACT

This invention relates to an improvement in an externally held cylindrical expander for tubular ware having a central support for radially adjustable expansible props and segment-shaped guide elements borne by the props, in particular for treating the tubular ware with liquid treatment substances, a longitudinally tapered body mounted to each end of the central support as entry and exit parts, and the guide elements extend in the longitudinal direction of the expander between the two bodies, the improvement comprising bearing means adapted to the shape of and surrounding at least in part at least the lower tapered body and including discharge apertures distributed on its interior periphery and issuing into a gap to said body for a fluid adapted to support the expander.

4 Claims, 2 Drawing Figures

EXTERNALLY HELD CYLINDRICAL EXPANDER FOR TUBULAR WARES

The invention concerns an externally held cylindrical expander for radially adjustable expansible prop means and segment-shaped guide elements borne by the prop means.

Expanders are known in a variety of designs. One of their essential features is that they contain guide elements expanding outwardly and placing themselves from the inside against the tubular ware and thereby expanding and tensioning it. Matching rollers are applied externally in the recesses of the expander which thereby is kept suspended.

As a rule the expanders are of flat design. Thus German Offenlegungsschrift No. 1,635,281 discloses a steam-setting machine for tubular knit wares equipped with a floating expander. The expander consists of two skids, the tubular ware being pulled over them. These skids include recesses with two narrow rollers placed in each, a matching roller resting from the outside between the two rollers in each case and hence supporting the expander in a suspended manner. Moving the material requires overcoming the appreciable friction between skid and ware. In this case the tubular material is kept flat correspondingly to the thickness of the skids. In another known expander and flattener, for instance that of German Offenlegungsschrift No. 1,949,543, two parallel supports are provided in lieu of the skids which are spread by means of parallel linkage means. In this case the ware is not pulled over the skids or supports themselves, but rather over rotating rollers, for the purpose of decreasing the friction, the rollers being distributed across the support. An endless conveyor belt furthermore may be placed over the set of rollers. This expander also is kept suspended by the outer matching rollers.

All these flat expanders have the drawback that the narrow skids or rollers and the externally matching rollers applied against them leave stripe-shaped traces on the material on account of their required compression, whereby the appearance of the ware is adversely affected. These drawbacks become especially marked and visible when treating the tubular goods with a liquid, for instance when mercerizing it, as in such a case high specific compression is needed and the squeezing effect, and hence the resulting stripes, become especially marked on the wet material. These stripes are made evident by a color variation or by a possible warping in the material.

Expanders furthermore are known which not only have a tensioning and flattening effect in a plane, but which also operate in several planes, that is spatially. Thus apparatus is disclosed in German Auslegeschrift No. 1,277,189, and German Offenlegungsschrift No. 1,460,592, which provide circularly arranged direction-changing rollers with endless tension belts placed on them. The tension belts move along with the tubular ware in the longitudinal direction of the machinery and are applied from the inside against the tubular goods. In this case also support rollers outside the ware are present, which cause the same above-cited drawbacks.

Another type of known expanders is described in German Pat. No. 466,211. This is a drying rack for tubular wares, in which the individual tensioning rings are subdivided into segments which are designed as expanding rings by helical springs superposed on them.

The individual segments are radially adjustable by means of scissor-like setting arms. Several such expanding rings together with their setting arms are mounted by means of displaceable sleeves to a central spindle and form a drying rack adaptable to the diameter of the tubular goods, in which the material to be dried is pulled over the individual annular helical springs. Connecting bars may be provided between the individual rings, extending in the axial direction, though these bars are used only for reinforcement, not to guide the material.

However, such an expander is unsuited for continuously moving the tubular material over it, especially so when the material must be treated with a liquid, and furthermore the material cannot be kept suspended using external means.

An externally held cylindrical expander already has been proposed for tubular wares, which comprises radially adjustable expansible prop means at a central support, these prop means holding guide elements for treating the tubular ware, especially with liquid treatment substances.

Bodies tapered in the longitudinal direction are mounted as entry and exit parts to the ends of the central support, the guide elements extending longitudinally along the expander between the bodies. Furthermore, support and transport rollers rest externally against these bodies, which are of a form adapted to those of the tapered bodies. This special design improves guiding the tubular ware over the expander, in particular expanding the incoming material, care being taken that substantial compressions by the support and transport rollers keeping the expander in its suspended position will be averted. While an appreciable reduction in specific the compression by the support and transport rollers is thus achieved, it still remains insufficient in many applications.

It is therefore the object of the present invention to further develop the expander in such a manner, and to so improve it, that it can be kept in its floating position at still lesser compressions.

This object is achieved for a cylindrical expander of the last-cited kind in that the invention provides for a bearing element adapted, at least within the bearing area of the expander, to the shape of the tapered body and enclosing this body at least in part, the bearing element including peripherally distributed discharge apertures issuing into the gap to the body and transmitting a flow means supporting the expander.

The bearing area is meant to be that region in which the expander rests in such a manner that on one hand its weight is supported and on the other centering is achieved. Centering the expander by a bearing element is also feasible elsewhere, for instance in the case of a vertically mounted expander at its upper end, where a bearing element will act as a pure guiding and centering means, and will not support the weight of the expander.

The bearing element need not be of integral design, rather it also may be composed of a number of individual components mounted around the tapered body. These individual components may join one another directly as sectors, or they also may have gaps between them.

The invention will be further illustrated by reference to the accompanying drawings, in which.

Figure 1:
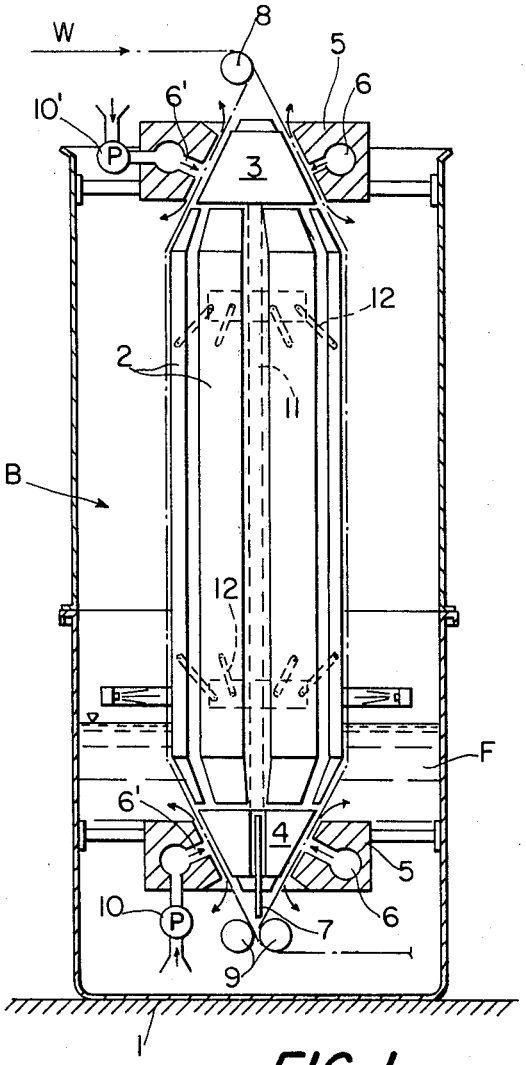
FIG. 1 is an expander in side view.

FIG. 1 shows, in simplified form, a treatment unit with an expander. The expander B is located in a container 1. The expander B at both its entry and exit ends includes a body 3 and 4 respectively in the shape of a frustrum-of-cone and both being seated on a continuous central support 11 shown in dashed lines. The segment-shaped guide elements 2 are located between the two frustrum-of-cone bodies, the entry part 3 and the exit part 4. The guide elements 2 form parts of a cylindrical surface for the expander B and slant at their upper and lower ends to correspond to the shape of the entry and exit parts 3 and 4 respectively. In known manner and not described further, the guide elements 2 are adjustable radially by means of the expansible propping means 12 shown in dashed lines. The path of the ware W is indicated in dash-dot manner. The ware is guided over the direction changing roller 8 to the expander, then is expanded by the entry part 3 and next passed over the guide elements 2 of the expander B. The treatment of the tubular ware takes place along this path, whether by gaseous or liquid treatment substances. The drawing indicates a ring of spray nozzles for a treatment liquid. The drawing further shows that the expander dips at least in part with its lower end into a liquid bath F. Beyond the frustrum-of-cone exit part 4, the tubular ware again is laid flat, for example by using the spreading blades 7. Thereupon, the material is guided over the exit rollers 9 and drawn off. The further path of the ware is not shown herein, nor is it essential to the invention.

As already mentioned above, the expander B is supported not by rollers, but by fluid cushions. To that end, the frustrum-of-cone bodies 3 and 4 at the entry and exit ends are surrounded by annular bearing elements 5. These bearing elements 5 are held by the container wall 1 in a manner not discussed further. The inside wall of the bearing elements 5 essentially corresponds in shape to that of the frustrum-of-cone bodies 3 and 4. The bearing elements 5 are so arranged that they leave a clear gap to the tapered body of the entry or exit end parts. If required, the annular shape of the bearing elements 5 is interrupted, for instance to receive a spreading blade 7.

The bearing element 5 includes, for instance, an annular channel 6 through which a fluid can be distributed to the periphery of this supporting element. Discharge apertures 6' pass from this annular channel into the gap between the bearing elements 5 and the opposite entry and exit parts 3 and 4 respectively. The fluid issuing in the direction of the arrow into the gap forms a cushion there, for instance a liquid cushion, or also an air cushion, which supports the expander B and braces it. The lower part of FIG. 1 shows that the expander dips at least in part into a bath of treatment liquid F. Therefore, a pump 10 is provided at the bearing element 5 to convey part of the liquid F into the annular channel 6 from whence it passes through the discharge apertures 6' into the gap. At the upper part, that is at the entry part 3 of the container B, the figure shows the case of the expander not dipping into a bath, but being clear of it. Therefore, provision is there made for the pump 10' moving air into the channel 6 and the discharge apertures 6'. The bearing element 5 at the upper part of the expander B is without supporting function, but rather it is required only to guide the entry part 3 in a lateral manner and to eliminate rollers and the like in this guidance.

Figure 2:
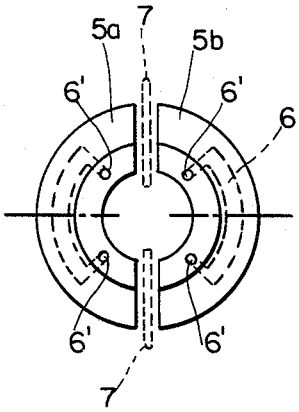
FIG. 2 is a top view of a bearing element.

FIG. 2 is a top view of the lower bearing element 5. It is assumed here that in lieu of a completely circularly connected element, two partial elements **5*a* and 5*b* are present. At those locations where the two partial elements contact each other, there is a gap within which the spreading blades 7, indicated in phantom, may be located. Therefore, the tapered body 4 is not completely surrounded by the bearing element, but only in part. Discharge apertures 6' for the fluid and associated supply channels 6 are indicated in dashed lines for each of the partial elements 5*a* and 5*b***.

Lastly, the possibility is indicated by the dash-dot lines that a bearing element 5 or **5*a* or 5*b*** can be further subdivided or split in another way. For a large number of partial elements, not every one need be provided with discharge apertures, though it is advantageous that each partial element include at least one discharge aperture and that the totality of all the discharge apertures be arranged in uniform distribution at the periphery of the bearing element.

By using the apparatus shown, any compression from solid support rollers will be eliminated at least in the area of the bearing and weight support region for the expander. The motion of the ware W can take place in an arbitrary manner, for instance the pair of exit rollers 9 shown at the lower end of the expander may be entirely adequate. On the other hand, conveyor rollers also may rest against part of the entry body 3 at the top and move the material. The design of the treatment housing and the manner of arranging the individual bearing elements can be adapted to the particular circumstances.

It will be obvious to those skilled in the art that many modifications may be made within the scope of the present invention without departing from the spirit thereof, and the invention includes all such modifications.

I claim:

1. In an externally held cylindrical expander for tubular ware having a central support for radially adjustable expansible props and segment-shaped guide elements borne by the props, in particular for treating the tubular ware with liquid treatment substances, a longitudinally tapered body mounted to each end of the central support as entry and exit parts, and the guide elements extend in the longitudinal direction of the expander between the two bodies, the improvement comprising bearing means conforming to the shape of and surrounding at least in part at least the lower tapered body and including discharge apertures distributed on the interior periphery of said tapered body, said discharge apertures issuing into a gap between said bearing means and said body, whereby a fluid issuing from said discharge apertures into said gap supports said expander.

2. An expander according to claim 1 adapted to be immersed at least partially into a bath of a treatment liquid, including means connecting discharge apertures to supply means for the treatment liquid in a region adapted to be immersed and means connecting discharge apertures to supply means for a gaseous fluid in a region which is not adapted to be immersed.

3. An expander according to claims 1 or 2 in which the bearing means is composed of a number of sector-shaped individual elements which can be assembled.

4. An expander according to claim 3 in which each individual element includes at least one discharge aperture.

* * * * *